US007372242B2

(12) United States Patent
Xi

(10) Patent No.: US 7,372,242 B2
(45) Date of Patent: May 13, 2008

(54) SYSTEM AND METHOD FOR GENERATING A REFERENCE VOLTAGE

(75) Inventor: Xiaoyu Frank Xi, Plano, TX (US)

(73) Assignee: Silicon Laboratories, Inc., Austin, TX (US)

( * ) Notice: Subject to any disclaimer, the term of this patent is extended or adjusted under 35 U.S.C. 154(b) by 167 days.

(21) Appl. No.: 11/022,044

(22) Filed: Dec. 23, 2004

(65) Prior Publication Data

US 2006/0139022 A1 Jun. 29, 2006

(51) Int. Cl.
*G05F 3/30* (2006.01)
*G05F 3/26* (2006.01)

(52) U.S. Cl. ..... 323/313; 323/315

(58) Field of Classification Search ..... 323/304, 323/311–316

See application file for complete search history.

(56) References Cited

U.S. PATENT DOCUMENTS 5,675,243 A * 10/1997 Kamata ..... 323/313
6,225,855 B1 * 5/2001 Taguchi ..... 327/538
6,232,756 B1 * 5/2001 Kurihara ..... 323/313
6,462,526 B1 * 10/2002 Tanase ..... 323/313
6,529,066 B1 * 3/2003 Guenot et al. ..... 327/539
6,788,041 B2 * 9/2004 Gheorghe et al. ..... 323/313

* cited by examiner

*Primary Examiner*—Gary L. Laxton
(74) *Attorney, Agent, or Firm*—Chowdhury & Georgakis, PC

(57) ABSTRACT

Systems and methods for generating a reference voltage are disclosed. In one embodiment, an output voltage is generated that is the sum of a desirable reference voltage component and an undesirable voltage component. An additional voltage component that tends to be equal and opposite in sign to the undesirable voltage component is added to the output voltage, the additional voltage component thereby tending to cancel the undesirable voltage component.

21 Claims, 3 Drawing Sheets

SYSTEM AND METHOD FOR GENERATING A REFERENCE VOLTAGE

I. BACKGROUND

A. Field of the Invention

The invention relates generally to reference voltage generators. More particularly, the invention relates to reference voltage generators that generate a conditions-insensitive reference voltage.

B. Description of the Related Art

Reference voltages are used in a wide variety of digital, analog, and mixed-signal circuits. Examples of circuits using reference voltages include analog-to-digital converters, digital-to-analog converters, and phase-locked loops. Analog-to-digital converters, for example, may use such reference voltages to accurately determine the magnitude of the analog input voltage—by comparing the input voltage to a well-known reference voltage—before converting the analog voltage to a digital signal.

The Brokaw cell is a popular reference voltage circuit that is widely used in many integrated circuits. The Brokaw cell requires a relatively high supply voltage, which limits the cell's application in today's advanced integrated circuits that operate with relatively low voltage power supplies. Many of today's advanced integrated circuits require relatively low voltage supplies to achieve lower power consumption and to generate less heat, among other things. Examples of devices requiring such low voltage supplies include mobile phones, personal data assistants, digital cameras, and other small, battery-operated devices. Alternative circuits to the Brokaw cell were developed that could operate with lower power supply voltages. While accomplishing lower supply voltage operation, however, these circuits generate reference voltages that include components that depend on the base currents of bipolar transistors used in the circuit.

For typical bipolar transistors having a large $\beta$ value—the ratio of collector to base current—the additional term is small compared to other currents in the circuit. In many integrated circuits, reference voltage circuits are formed using parasitic bipolar transistors that have a relatively low $\beta$ value. Thus, the base current term can affect the sensitivity of the reference voltage as the base current may vary with temperature, power supply, and load variations, for example.

II. SUMMARY

Systems and methods for generating a reference voltage are disclosed. An output voltage is generated that includes a desirable reference voltage component, which is insensitive to environment variables, and an undesirable, circuit variables-sensitive voltage component. An additional voltage component is added to the output voltage having a magnitude that is approximately equal and opposite in sign to the magnitude of the undesirable voltage component thereby tending to cancel the undesirable component such that the output voltage tends to be equal to the desirable reference voltage component.

According to one embodiment, a reference voltage is generated using a circuit, the reference voltage being the sum of a first, a second, a third, and a fourth voltage component. The first voltage component depends on a difference in the base-emitter voltages of a first bipolar transistor and a second bipolar transistor, a voltage difference that has a positive temperature coefficient. The second voltage component depends on the base current of a bipolar transistor in the circuit. The third voltage component also depends on the base current but has an opposite sign to the second voltage component. The fourth voltage component depends on the base-emitter voltage of one of the transistors, a voltage that has a negative temperature coefficient. By appropriately choosing the circuit parameters—such as resistor values and transistor characteristics, for example—the second and third voltage components substantially cancel (or tend to cancel) each other such that the reference voltage is substantially independent (or tends to be independent) of the base current. Similarly, by appropriately choosing additional circuit parameters, the positive temperature coefficient of the first voltage component and the negative temperature coefficient of the fourth voltage component tend to cancel each other at a predetermined temperature such that the temperature coefficient of the reference voltage tends to zero as the temperature of the circuit tends to the predetermined temperature. In addition, the reference voltage tends to be independent of other circuit variables and in particular the base current. The predetermined temperature can be chosen to be the typical operating temperature of the circuit such that the reference voltage is insensitive to temperature variations for temperatures in the neighborhood of the circuit's typical operating temperature.

In one embodiment, the circuit includes a first transistor having a first collector, a first base, and a first emitter; a second transistor having a second collector, a second base, and a second emitter, and a third transistor having a third collector, a third base, and a third emitter. In addition, the circuit includes a base resistor having a first and a second terminal, a first resistor having a first and a second terminal, and a second resistor having a first and a second terminal. The circuit may also include a first, a second, and a third current source.

In one embodiment, the first base is coupled to the first terminal of the base resistor, the second terminal of the base resistor is coupled to the second base, the second emitter is coupled to the first terminal of the first resistor, and the second terminal of the first resistor is coupled to ground and to the first emitter to form a loop. Since the voltage drop around any loop is equal to zero, the voltage drop across the first resistor is equal to the difference in base-emitter voltages of the first and second transistors (which is used to form the first voltage component) after subtracting the voltage drop across the base resistor (which is used to form the third voltage component).

The first collector is coupled to the first current source and the second collector is coupled to a second current source. By setting the second collector current to be a predetermined ratio of the first collector current and by setting the area of the second collector to be a predetermined ratio of the area of the first collector, the difference in base-emitter voltages of the first and second transistors depends on absolute temperature and the natural log of the ratio of the current densities of the two collectors.

The reference voltage is generated at the first terminal of the second resistor. The first terminal of the second resistor is coupled to a third current source, the second terminal of the second resistor is coupled to the third collector, the third collector is coupled to the third base, and the third emitter is coupled to ground. Thus, the reference voltage is equal to the sum of the voltage drop across the second transistor and the base-emitter voltage of the third transistor (which gives rise to the fourth voltage component).

The second terminal of the second resistor is also coupled to the first base. Thus, the current through the second resistor is equal to the sum of the first base current, the second base current (which is a predetermined ratio of the first base current), and the third emitter current. The voltage drop across the second resistor has a first term that is proportional to the second base current (which gives rise to the second voltage component) and a second term that is proportional to the third emitter current. The ratio of the third emitter current to the first emitter current is equal to the ratio of the areas of the third and first transistors. Thus, the second term of the voltage drop across the second resistor is proportional to the voltage drop across the first resistor (which gives rise to the first and third voltage components). The reference voltage may be scaled by adding a third resistor across the third base and the third emitter contributing a current through and a voltage across the second resistor. The additional voltage term increases the value of the reference voltage.

In one respect, disclosed is a method for generating a reference voltage, including: generating an output voltage that is the sum of a reference voltage component and an undesirable voltage component; and adding an additional voltage component to the output voltage, the additional voltage component tending to be equal and opposite in sign to the undesirable voltage component thereby tending to cancel the undesirable voltage component.

In another respect, disclosed is a method for generating a reference voltage, including: (1) applying a supply voltage to a circuit; (2) generating a first voltage component that has a positive temperature coefficient; (3) generating a second voltage component that is dependent on one or more circuit variables; (4) generating a third voltage component that tends to be equal and opposite in sign to the second voltage component; (5) generating a fourth voltage component that has a negative temperature coefficient, the positive temperature coefficient and the negative temperature coefficient tending to be equal in magnitude at a predetermined temperature; and (6) summing the first, the second, the third, and the fourth voltage components to generate the reference voltage, the reference voltage tending to be independent of the circuit variables, and a temperature coefficient of the reference voltage tending to zero at the predetermined temperature.

In yet another respect, disclosed is an information handling system, the information handling system including an apparatus that is adapted to: generate an output voltage that is the sum of a reference voltage component and an undesirable voltage component; and add an additional voltage component to the output voltage, the additional voltage component tending to be equal and opposite in sign to the undesirable voltage component, thereby tending to cancel the undesirable voltage component.

Numerous additional embodiments are also possible.

III. BRIEF DESCRIPTION OF THE DRAWINGS

Other objects and advantages of the invention may become apparent upon reading the detailed description and upon reference to the accompanying drawings.

Figure 1:
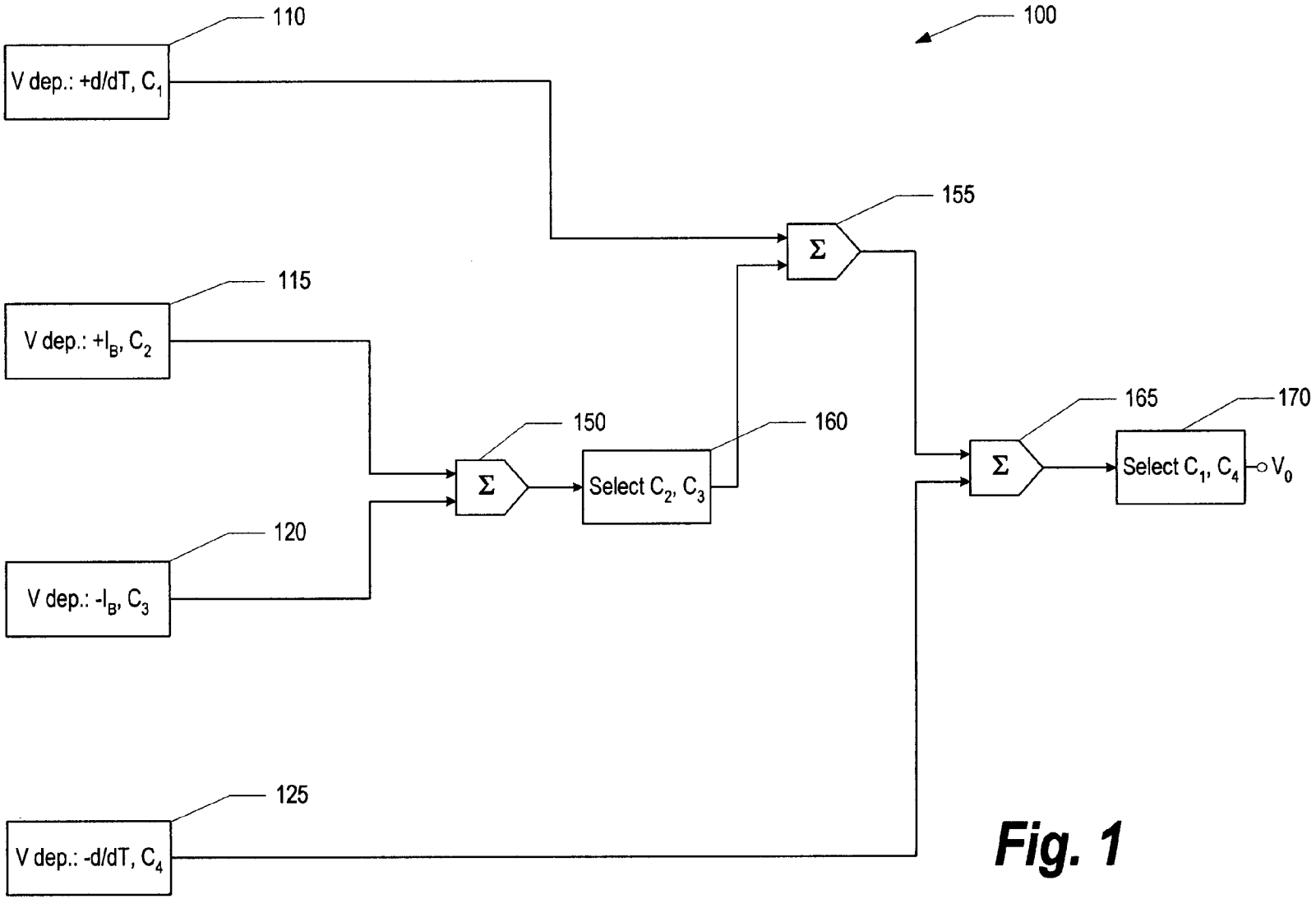
FIG. 1 is a conceptual block diagram illustrating the operation of a low-voltage reference voltage generator configured to generate a reference voltage that is insensitive to temperature variations and is independent of base currents in accordance with one embodiment.

While the invention is subject to various modifications and alternative forms, specific embodiments thereof are shown by way of example in the drawings and the accompanying detailed description. It should be understood, however, that the drawings and detailed description are not intended to limit the invention to the particular embodiment. This disclosure is instead intended to cover all modifications, equivalents, and alternatives falling within the scope of the present invention as defined by the appended claims.

IV. DETAILED DESCRIPTION

One or more embodiments of the invention are described below. It should be noted that these and any other embodiments are exemplary and are intended to be illustrative of the invention rather than limiting. While the invention is widely applicable to different types of systems, it is impossible to include all of the possible embodiments and contexts of the invention in this disclosure. Upon reading this disclosure, many alternative embodiments of the present invention will be apparent to persons of ordinary skill in the art.

Referring to FIG. 1, a conceptual block diagram illustrating the operation of a low-voltage reference voltage generator configured to generate a reference voltage that is insensitive to temperature variations and is independent of base currents in accordance with one embodiment is shown. Voltage generator 100 may be configured to generate a reference voltage that has a temperature coefficient that tends to zero as the temperature approaches a predetermined temperature and is substantially equal to zero for temperatures in the neighborhood of the predetermined temperature. The reference voltage also tends to be independent of other circuit variables while operating with a relatively low voltage supply. In one embodiment, voltage generator 100 may be implemented as a circuit of electronic hardware. In other embodiments, voltage generator 100 may be implemented with computer software and in yet other embodiments with a combination of computer software and electronic hardware.

Voltage generator 100 comprises, among other components, voltage generator 110, voltage generator 115, voltage generator 120, and voltage generator 125. Voltage generator 110 may be configured to generate a first voltage component that has a positive temperature coefficient. In an embodiment where voltage generator 100 is implemented using a circuit, the first voltage component may depend on the difference in base-emitter voltages of two of the circuit's bipolar transistors that are operating with unequal collector current densities. The first voltage component may also depend on a first set of circuit parameters ($C_1$). The first set of circuit parameters may include, for example, resistor values, transistor characteristics, etc.

Voltage generator 115 may be configured to generate a second voltage component. In an embodiment where voltage generator 100 is implemented using a circuit, the second voltage component may depend on a base current of one of the circuit's bipolar transistors. The second voltage component may also depend on a second set of circuit parameters ($C_2$). The second set of circuit parameters may include, for example, resistor values, transistor characteristics, etc.

Voltage generator 120 may be configured to generate a third voltage component. In an embodiment where voltage generator 100 is implemented using a circuit, the third voltage component may also depend on the base current of one of the circuit's bipolar transistors. The second and third voltage components may have base current coefficients that are opposite in sign. The third voltage component may also depend on a third set of circuit parameters ($C_3$). The third set of circuit parameters may include, for example, resistor values, transistor characteristics, etc.

Voltage generator 125 may be configured to generate a fourth voltage component that has a negative temperature coefficient. In an embodiment where voltage generator 100 is implemented using a circuit, the fourth voltage component may depend on the base-emitter voltage of a bipolar transistor in the circuit. The fourth voltage component may also depend on a fourth set of circuit parameters ($C_4$). The fourth set of circuit parameters may include, for example, resistor values, transistor characteristics, etc.

Adder 150 is configured to generate a sum of the second and third voltage components. Parameter selector 160 is configured to set one or more parameters from the second set of circuit parameters and one or more parameters from the third set of circuit parameters such that the sum of the second and third components tends to zero or is substantially equal to zero. In an embodiment where the dependence of the second and third components on the base current is linear, the sum of the second and third components tends to zero for all the values of the base current. As a result, the output of parameter selector 160 tends to zero, is substantially equal to zero, or is equal to zero. Accordingly, when the voltage output of parameter selector 160 is added to the first voltage component by adder 155, the output is approximately equal to the first voltage component.

The fourth voltage component is then added to the output of adder 155 (which is equal to the first voltage component) by adder 165. Parameter selector 170 is configured to set one or more parameters from the first set of circuit parameters and one or more parameters from the fourth set of circuit parameters such that the output reference voltage ($V_0$) has a temperature coefficient that tends to zero as temperature approaches a predetermined temperature and is substantially equal to zero for temperatures in the neighborhood of the predetermined temperature. In another embodiment, the temperature coefficient may be equal to zero or may be substantially equal to zero for all temperatures (for example, an embodiment where the temperature dependence of the first and fourth voltage components is linear). In one embodiment, the predetermined temperature is chosen to be the operating temperature of voltage generator 100.

Accordingly, the output reference voltage is insensitive to temperature changes for temperatures in the neighborhood of the predetermined temperature. The output reference voltage is also substantially independent (or tends to be independent) of the base current as well as other circuit variables such as the power supply and the load.

Figure 2:
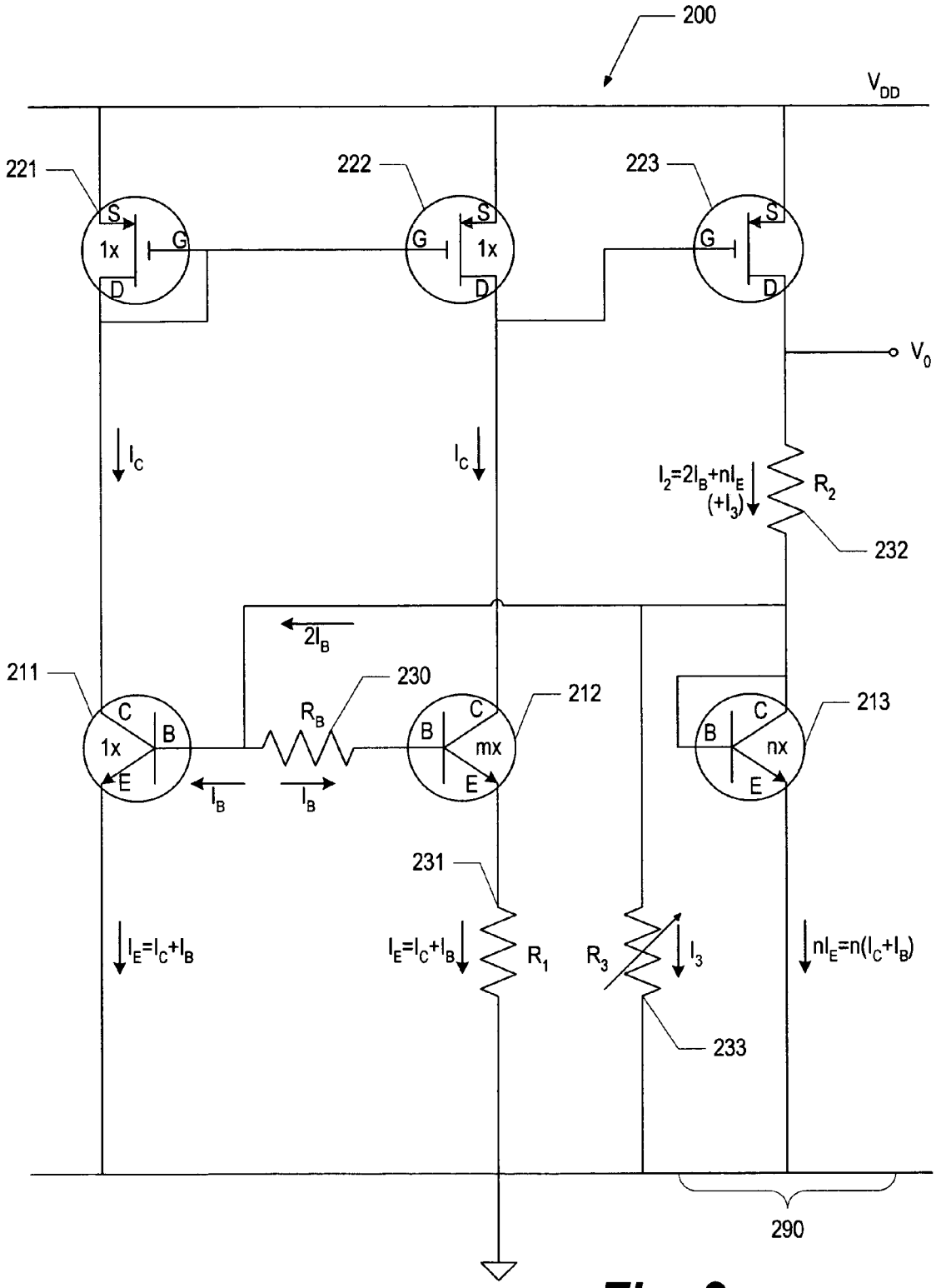
FIG. 2 is a circuit diagram illustrating a low-voltage reference voltage generator configured to generate a reference voltage that is insensitive to temperature variations and independent of base currents in accordance with one embodiment.

Referring to FIG. 2, a circuit diagram illustrating a low-voltage reference voltage generator configured to generate a reference voltage that is insensitive to temperature variations and independent of base currents in accordance with one embodiment is shown. Circuit 200 is configured to generate a reference voltage that has a temperature coefficient that tends to zero as temperature approaches a predetermined temperature and is substantially equal to zero in the neighborhood of the predetermined temperature. The reference voltage also tends to be independent of circuit variables while operating with a relatively low voltage power supply.

A first component of the reference voltage ($V_0$) depends on the difference in the base-emitter voltages ($\Delta V_{BE}$) of bipolar transistor 211 ($V_{BE_1}$) and bipolar transistor 212 ($V_{BE_2}$). This voltage difference is approximately proportional to absolute temperature (as is well-known in the art) and thus has a positive temperature coefficient. A second voltage component of the reference voltage depends on the base-emitter voltage of bipolar transistor 213 ($V_{BE_3}$). The base-emitter voltage of a bipolar transistor typically has a negative temperature coefficient. The reference voltage ($V_0$) is equal to the sum of the base-emitter voltage of transistor 213 and the voltage drop across resistor 232 ($R_2$). Accordingly, the temperature coefficient of the reference voltage ($V_0$) can tend to zero as temperature approaches a predetermined temperature ($T_0$) by appropriately choosing circuit parameters ($dV_0/dT|_{T=T_0}=0$).

The difference in the base-emitter voltages of two bipolar transistors driven with unequal collector current densities is given by:

$$\Delta V_{BE} = \frac{kT}{e}\ln\left(\frac{J_1}{J_2}\right),$$

where k is the Boltzman constant, T is the absolute temperature, e is the charge of the electron, and $J_{1\ and\ J2}$ are the collector current densities of the bipolar transistors.

FET transistors 221 and 222 are arranged in a current mirror configuration such that the collector current ($I_C$) of bipolar transistor 211 is equal to (or scaled with, in other embodiments) the collector current ($I_C$) of bipolar transistor 212. In other embodiments, other types of current sources may be used to generate the collector currents.

In one embodiment, the area of bipolar transistor 212 is chosen to be equal to m times the area of bipolar transistor 211; otherwise, the two transistors have similar characteristics. Accordingly, the two bipolar transistors have an equal base current ($I_B$) and an equal emitter current ($I_E$).

Since the voltage drop along the loop formed by transistor 211, base resistor 230, transistor 212, and first resistor 231 is equal to zero, the voltage drop across first resistor 231 is equal to:

$V_{R_1}=I_E R_1=\Delta V_{BE}-I_B R_B$, which implies that:

$$I_E = \frac{1}{R_1}\Delta V_{BE} - \frac{R_B}{R_1} I_B.$$

Here, $\Delta V_{BE}$ is the difference in base-emitter voltages of transistors 211 and 212.

The generated reference voltage ($V_0$) is equal to the sum of the voltage drop across resistor 232 ($R_2$) and the base-emitter voltage of bipolar transistor 213. The area of bipolar transistor 213 is chosen to be equal to n times the area of bipolar transistor 211; otherwise, the two transistors have similar characteristics. Because transistors 211 and 213 are arranged in current mirror configuration, the emitter current of bipolar transistor 213 is equal to n times the emitter current of bipolar transistor 211. Thus, the current through and the voltage across resistor 232 are equal to $I_2=2I_B+nI_E$ and $V_{R_2}=(2I_B+nI_E)R_2$, assuming for now that resistor 233 is set to infinite resistance (open circuit).

After substituting for the emitter current ($I_E$) with the expression obtained above, the reference voltage becomes:

$$V_0 = \frac{nR_2}{R_1}\ln(m)\frac{k}{e}T + 2R_2I_B - \frac{nR_2R_B}{R_1}I_B + V_{BE}.$$

The reference voltage comprises: a first term that has a positive temperature coefficient; a second term that depends on the base current; a third term that depends on the negative of the base current; and a fourth term that has a negative temperature coefficient. The second and third terms can be eliminated by setting:

$$\frac{nR_B}{R_1} = 2,$$

by appropriately choosing values for n, $R_1$, and $R_B$, thereby making the reference voltage independent (or substantially or tending to be independent) of the base current. For example, if we choose:

n=2 and $R_B$=$R_1$, the reference voltage becomes:

$$V_0 = \frac{2R_2}{R_1}\ln(m)\frac{k}{e}T + V_{BE}.$$

By choosing appropriate values for m, $R_1$, and $R_2$ (and considering the values of other transistor characteristics), that satisfy the equation:

$$(dV_0/dT|_{T=T_0}=0)$$

the reference voltage can have a zero temperature coefficient at a predetermined temperature ($T_0$). In one embodiment, the predetermined temperature may be chosen to be the operating temperature of the device. For silicon-based integrated circuits, the minimum value for the reference voltage generated is approximately equal to the bandgap of silicon.

In another embodiment, values for resistor 233 other than infinity (open circuit) may be chosen in order to scale the reference voltage to higher values. By drawing current through resistor 233, an additional voltage component is generated across second resistor 232. As a result, the reference voltage is now given by:

$$V_0 = \frac{2R_2}{R_1}\ln(m)\frac{k}{e}T + \left(1 + \frac{R_1}{R_3}\right)V_{BE}.$$

By appropriately choosing values for $R_3$, higher reference voltage values can be obtained.

The reference voltage has a first term that has positive temperature coefficient and a second term that has a negative temperature coefficient and can thus have a zero temperature coefficient at a given temperature. The reference voltage is also independent of circuit variables Referring to output leg 290 of the circuit, in one embodiment, the voltage difference between the supply voltage ($V_{DD}$) and the reference voltage ($V_0$) is equal to the source-drain voltage of transistor 223. Thus, in one embodiment, the minimum required supply voltage ($V_{DD}$) is equal to the sum of the reference voltage ($V_0$) and the drain saturation voltage of transistor 223.

It should be noted that other types of transistors (such as MOS-type transistors) and other types of devices (such as diodes) may be used to generate the positive and negative temperature coefficients. In addition, individual devices in the circuit as well as groups of devices in the circuit may be substituted with other devices of comparable functionality. Circuit 400 may be used in a variety of circuit types such as integrated circuits, circuit boards, etc.

Figure 3:
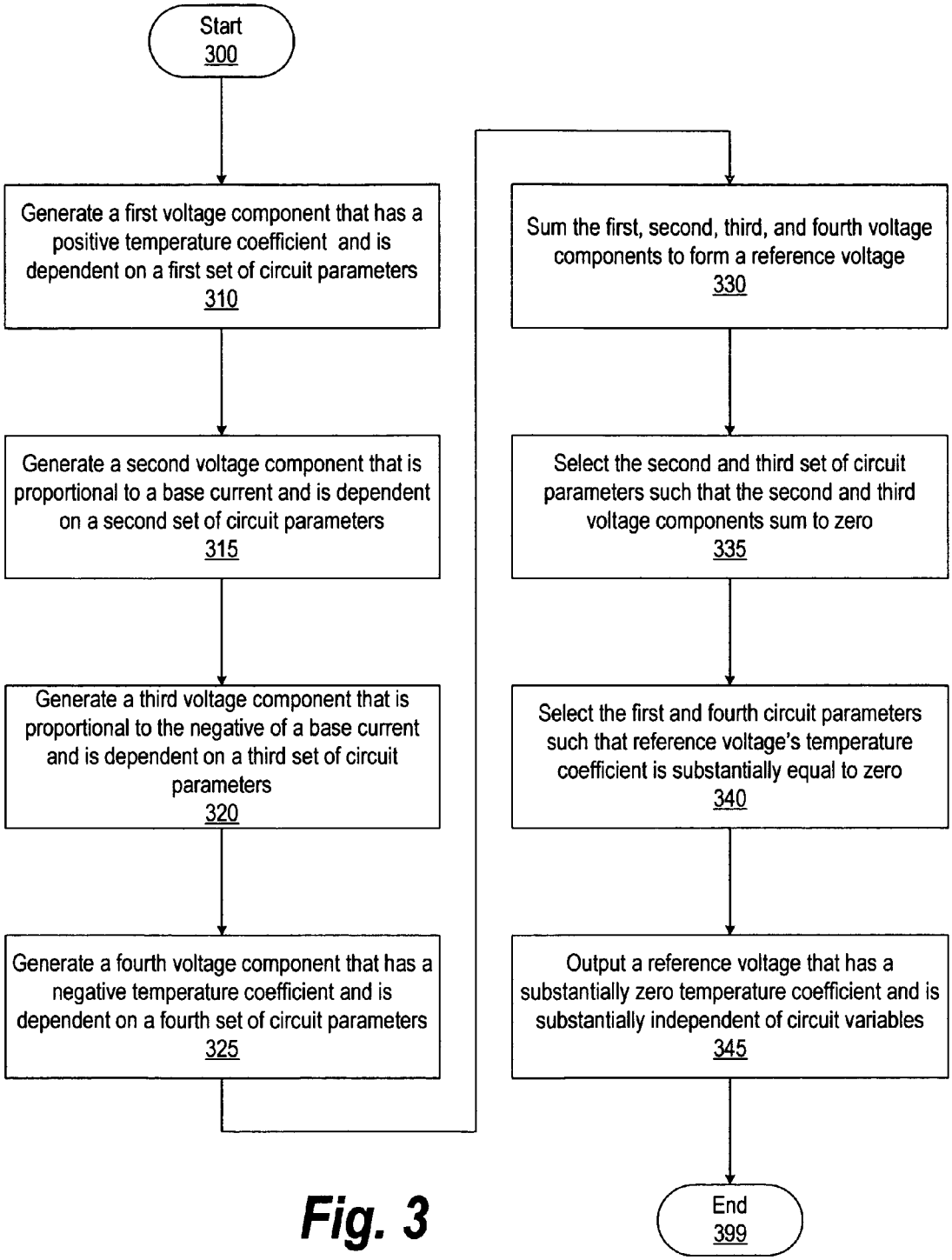
FIG. 3 is a flowchart illustrating a method for generating a reference voltage that is insensitive to temperature variations as well as independent of base currents in accordance with one embodiment.

Referring to FIG. 3, a flowchart illustrating a method for generating a reference voltage that is insensitive to temperature variations as well as independent of base currents in accordance with one embodiment is shown. In one embodiment, the method may be implemented as a circuit of electronic hardware. In other embodiments, the method may be implemented with computer software and in yet other embodiments with a combination of computer software and electronic hardware.

The method begins at 300 whereupon, at block 310, a first voltage component is generated. In an embodiment where the method is implemented using a circuit, the first voltage component has a positive temperature coefficient and is dependent on a first set of circuit parameters. In one embodiment, the first voltage component may depend on the difference in the base-emitter voltages of two bipolar transistors having predetermined and unequal collector current densities. For example, an equal current may be forced through the collectors of two bipolar transistors having unequal collector areas. The first set of circuit parameters may include resistance values as well as transistor characteristics values.

At block 315, a second voltage component is generated. In an embodiment where the method is implemented using a circuit, the second voltage component is dependent on a base current of a bipolar transistor in the circuit. The second voltage component is dependent on a second set of circuit parameters. The second set of circuit parameters also may include resistance values as well as transistor characteristics values.

At block 320, a third voltage component is generated. In an embodiment where the method is implemented using a circuit, the third voltage component is also dependent on the base current of the bipolar transistor in the circuit. The second and third voltage components have, however, base current coefficients of opposite sign. The third voltage component is dependent on a third set of circuit parameters that may include resistance values, transistor characteristics values, etc.

At block 325, a fourth voltage component is generated. In an embodiment where the method is implemented using a circuit, the fourth voltage component has a negative temperature coefficient and is dependent on a fourth set of circuit parameters. In one embodiment, the fourth voltage component may depend on the base-emitter voltage of a bipolar transistor in the circuit. The fourth set of circuit parameters may include resistance values, transistor characteristics values, etc.

At block 330, the first, second, third, and fourth voltage components are summed to generate a reference voltage, and at block 335, appropriate values for one or more parameters from the second and third sets of circuit parameters are chosen such that the second and third voltage components sum substantially to zero (or tend to sum to zero). Accordingly, the generated reference voltage becomes substantially independent (or tends to be independent) of the base current.

At block 340, appropriate values for one or more parameters from the first and fourth sets of circuit parameters are chosen such that the sum of the first and fourth voltage components has a temperature coefficient that is substantially equal to zero (or tends to zero) at a predetermined temperature. Accordingly, the reference voltage varies slowly with temperature for temperatures in the neighborhood of the predetermined temperature.

Those of skill will appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Those of skill in the art may implement the described functionality in varying ways for each particular application, but such implementation decisions should not be interpreted as causing a departure from the scope of the present invention.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

The benefits and advantages that may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the following claims.

The invention claimed is:

1. A method comprising:

generating an output voltage, the output voltage being the sum of a reference voltage component and an undesirable voltage component, wherein the reference voltage component is substantially independent of circuit variables, wherein a temperature coefficient of the reference voltage component is substantially equal to zero at a predetermined temperature, wherein the reference voltage is the sum of a term having a positive temperature coefficient and another term having a negative temperature coefficient, and wherein the positive temperature coefficient and the negative temperature coefficient substantially cancel each other at the predetermined temperature; and adding an additional voltage component to the output voltage, wherein the additional voltage component is substantially equal and opposite in sign to the undesirable voltage component, the additional voltage component thereby substantially canceling the undesirable voltage component.

2. The method of claim 1, wherein the positive temperature coefficient depends on a difference in base-emitter voltages of a first and a second bipolar transistor, and wherein the negative temperature coefficient depends on a base-emitter voltage of one of the bipolar transistors or of a third bipolar transistor.

3. The method of claim 1, wherein the undesirable voltage component depends on one or more circuit variables.

4. The method of claim 3, wherein the one or more circuit variables depend on a current term.

5. The method of claim 4, wherein the current term depends on a base current of a bipolar transistor.

6. A method comprising:

applying a supply voltage to a circuit;

generating a first voltage component, the first voltage component having a positive temperature coefficient;

generating a second voltage component, the second voltage component being dependent on one or more circuit variables;

generating a third voltage component, the third voltage component being substantially equal and opposite in sign to the second voltage component;

generating a fourth voltage component, the fourth voltage component having a negative temperature coefficient, and wherein the positive temperature coefficient and the negative temperature coefficient are substantially equal in magnitude at a predetermined temperature; and summing the first, the second, the third, and the fourth voltage components to generate a reference voltage, the reference voltage being substantially independent of the circuit variables and a temperature coefficient of the reference voltage being substantially equal to zero at the predetermined temperature.

7. The method of claim 6, wherein:

the first voltage component is dependent on a difference in base-emitter voltages of a first bipolar transistor and a second bipolar transistor, the second voltage component is dependent on a base current of one of the bipolar transistors or a third bipolar transistor, the third voltage component is dependent on a negative of the base current, and the fourth voltage component is dependent on a base-emitter voltage of one of the bipolar transistors or of the third bipolar transistor.

8. The method of claim 7, wherein a sum of the positive temperature coefficient and the negative temperature coefficient is substantially equal to zero at the predetermined temperature in response to appropriately choosing parameters in the circuit.

9. The method of claim 8, wherein the circuit parameters are chosen from the group consisting of resistor values and transistor characteristics.

10. An information handling system, the information handling system comprising an apparatus, the apparatus adapted to:

generate an output voltage, the output voltage being the sum of a reference voltage component and an undesirable voltage component, wherein the reference voltage component is substantially independent of circuit variables, wherein a temperature coefficient of the reference voltage component is substantially equal to zero at a predetermined temperature, wherein a temperature coefficient of the reference voltage component is substantially equal to zero at a predetermined temperature, and wherein the reference voltage is the sum of a term having a positive temperature coefficient and another term having a negative temperature coefficient, the positive temperature coefficient and the negative temperature coefficient substantially canceling each other at the predetermined temperature; and add an additional voltage component to the output voltage, the additional voltage component being substantially equal and opposite in sign to the undesirable voltage component, the additional voltage component thereby substantially canceling the undesirable voltage component.

11. The information handling system of claim 10, wherein the apparatus is a voltage generator circuit.

12. The information handling system of claim 10, wherein the positive temperature coefficient depends on a difference in base-emitter voltages of a first and a second bipolar transistor, and wherein the negative temperature coefficient depends on a base-emitter voltage of one of the bipolar transistors or of a third bipolar transistor.

13. The information handling system of claim 10, wherein the undesirable voltage component depends on one or more circuit variables.

14. The information handling system of claim 13, wherein the one or more circuit variables depend on a current term.

15. The information handling system of claim 14, wherein the current term depends on a base current of a third bipolar transistor.

16. A circuit comprising:

a first transistor, the first transistor having a first collector, a first base, and a first emitter, the circuit adapted to generate a first collector current, a first base current, and a first emitter current;

a second transistor, the second transistor having a second collector, a second base, and a second emitter, the circuit adapted to generate a second collector current, a second base current, and a second emitter current;

a third transistor, the third transistor having a third collector, a third base, and a third emitter, the circuit adapted to generate a third collector current, a third base current, and a third emitter current;

a base resistor, the base resistor having a base resistor first terminal and a base resistor second terminal;

a first resistor, the first resistor having a first resistor first terminal and a first resistor second terminal; and a second resistor, the second resistor having a second resistor first terminal and a second resistor second terminal;

wherein:

the first base is coupled to the first terminal of the base resistor, the second terminal of the base resistor is coupled to the second base, the second emitter is coupled to the first terminal of the first resistor, and the second terminal of the first resistor is coupled to the first emitter to form a loop, the first collector is adapted to be coupled to a first current source generating the first collector current and the second collector is adapted to be coupled to a second current source generating the second collector current, the first terminal of the second resistor is adapted to be coupled to a third current source, the second terminal of the second resistor is coupled to the third collector, the third collector is coupled to the third base, and the third emitter is coupled to the second terminal of the first resistor, the second terminal of the second resistor is coupled to the first base, and the circuit is adapted to generate a reference voltage at the first terminal of the second resistor.

17. The circuit of claim 16, wherein:

in response to the first collector current being substantially equal to the second collector current, the first base current is substantially equal to the second base current and the first emitter current is substantially equal to the second emitter current, a voltage drop across the first resistor is substantially equal to the difference in base-emitter voltages of the first and the second transistors minus a voltage drop across the base resistor, a current from the second terminal of the second resistor to the first base is substantially equal to twice the first base current, in response to an area of the third transistor being substantially equal to "n" times the area of the first transistor, an emitter current of the third transistor is substantially equal to "n" times the emitter current of the first transistor, and the voltage drop across the second resistor is substantially equal to a first term that is substantially proportional to the difference in base-emitter voltages of the first and second transistors plus a second term that is substantially proportional to the negative of the second base current;

in response to a current through the second resistor being substantially equal to twice the second base current plus the third emitter current, the voltage drop across the second resistor is substantially the sum of:

a first voltage component, which is substantially proportional to the difference in the base-emitter voltages of the first and second transistor, a second voltage component, which is substantially proportional to the second base current, and a third voltage component, which is substantially proportional to the negative of the second base current, a fourth voltage component is substantially equal to base-emitter voltage of the third transistor, and the reference voltage is substantially equal to the first voltage component plus the second voltage component plus the third voltage component plus the fourth voltage component.

18. The circuit of claim 17, wherein the circuit further comprises a third resistor, a first terminal of the first resistor is coupled to the third collector, and a second terminal of the resistor is coupled to third emitter, thereby adding an additional voltage component to the reference voltage.

19. The circuit of claim 16, wherein the first, the second, and the third transistors are parasitic bipolar transistors having relatively low betas.

20. The circuit of claim 16, wherein the first and second current sources comprise two field-effect transistors arranged in a current minor configuration.

21. The circuit of claim 17, wherein a semiconductor compound used to fabricate the first, second, and third transistors is silicon, and a minimum value of the reference voltage is substantially equal to a bandgap of silicon.

* * * * *